United States Patent [19]

Hörmann

[11] Patent Number: 4,753,057

[45] Date of Patent: Jun. 28, 1988

[54] LENGTH OF SECTION FOR FRAMING THE LEAF OF A GATE OR DOOR

[75] Inventor: Michael Hörmann, Steinhagen, Fed. Rep. of Germany

[73] Assignee: Hörmann KG Amshausen, Steinhagen, Fed. Rep. of Germany

[21] Appl. No.: 833,722

[22] Filed: Feb. 26, 1986

[30] Foreign Application Priority Data

Feb. 27, 1986 [DE] Fed. Rep. of Germany ..... 3506941

[51] Int. Cl.[4] ..... E04C 3/30

[52] U.S. Cl. ..... 52/720; 52/822; 29/526 R

[58] Field of Search ..... 52/731, 784, 822, 830, 52/633, 620, 720; 403/408, 388, 4, 312, 309, 313; 29/526 R

[56] References Cited

U.S. PATENT DOCUMENTS

| | | | |
|---|---|---|---|
| 149,965 | 4/1874 | Wheeler | 52/731 |
| 972,102 | 10/1910 | Eichmann | 52/731 |
| 1,114,135 | 10/1914 | Hafertep | 29/526 R |
| 2,347,411 | 4/1944 | Hefler | 29/526 R |
| 3,006,443 | 10/1961 | Siler | 403/408.1 |
| 3,304,109 | 2/1967 | Schuster | 29/526 R |
| 3,456,972 | 7/1969 | Drotar | 403/408.1 |
| 3,882,756 | 5/1975 | Sauer | 29/526 R |
| 3,986,318 | 10/1976 | McConnell | 403/408.1 |
| 4,402,170 | 9/1983 | Seidner | 52/731 |

FOREIGN PATENT DOCUMENTS

| | | | |
|---|---|---|---|
| 205727 | 3/1959 | Austria | 52/633 |
| 1028767 | 4/1958 | Fed. Rep. of Germany | 52/633 |
| 2253244 | 5/1974 | Fed. Rep. of Germany | 52/822 |
| 1190820 | 10/1959 | France | 52/822 |
| 1394950 | 3/1965 | France | 52/633 |
| 533825 | 12/1953 | Italy | 52/633 |
| 714692 | 9/1954 | United Kingdom | 52/731 |

*Primary Examiner*—Henry E. Raduazo
*Attorney, Agent, or Firm*—Max Fogiel

[57] ABSTRACT

A length of section for framing the leaf of a gate or door or other structure that closes off a building and with a panel, preferably a wooden panel, especially for swinging doors with a sectional strut made out of a strip of sheet metal that is shaped in such a way that its two longitudinal borders are joined parallel into a web designed as a mount for the panel and having perforations for the screws that secure the panel extending through both longitudinal borders. To make sure that the screws will fit through all the perforations once the strip has been shaped into a length of section, the perforations in one longitudinal border are larger than the perforations in the other longitudinal border and in the cross-section of each smaller perforation in the web on the sectional strut is in the vicinity of the correspondingly positioned larger perforation.

5 Claims, 1 Drawing Sheet

LENGTH OF SECTION FOR FRAMING THE LEAF OF A GATE OR DOOR

BACKGROUND OF THE INVENTION

The present invention relates to a framing profile for constructing a frame for a door or gate and similar closure for a house. The framing profile is particularly applicable to swinging doors, in which a panel, preferably wooden panel, is inserted into the frame. The framing profile comprises a strip of sheet metal which is provided with a row of equally spaced openings in the strip's longitudinal side edges. The strip of sheet metal is shaped into a profiled member so that both side edges are placed together as parallel flanges which serve to hold the panel with fastening bolts passing through the openings.

Structural sections of the aforementioned type have for a long time been provided individually, subsequent to being shaped and to that extent finished, with perforations or apertures for accommodating the screws or similar structures that secure the panel, especially a wooden panel, to the frame. This procedure is laborious and time-consuming and deleterious to well-planned manufacture.

SUMMARY OF THE INVENTION

The object of the present invention is to provide a framing section of the aforesaid type in which the perforations for accommodating the screws that secure the panel are already present once a sectional strut has been shaped.

The strip of flat sheet metal that is to be shaped into the desired structural section has edges that will finally constitute flanges. To avoid the troublesome subsequent introduction of perforations for accommodating the screws that secure the panel, it is conceivable to provide the edges with perforations of the same diameter as the screws, before the strip is shaped. Manufacturing tolerances will of course occur during the subsequent shaping process and will prevent the dimensionally matched perforations through each edge of the strip of sheet metal from coinciding perfectly once the web has been shaped, so that the perforations will be mutually displaced. The result will be a more or less elliptical perforation that the screws will not fit through, requiring subsequent labor that is just as undesirable as introducing the perforations into the already shaped flanges.

Thus, one longitudinal edge of the strip of sheet metal that is to be shaped into the desired sectional strut is, in accordance with the invention, provided before being shaped with perforations of the same diameter as the screws that secure the panel. The other longitudinal edge of the strip, on the other hand, is provided with perforations with a cross-section that is larger than is necessary to accommodate the screws. The extent to which the latter perforations are larger than the former depends on the manufacturing tolerances that occur when the strip of sheet metal is shaped into the desired structural section, or on the extent to which each pair of associated screw-accommodation perforations is displaced in relation to each other. Specifically, the cross-section of the larger perforations must cover that of the associated smaller perforations to the extent that the screws that secure the panel will fit through both perforations with no need for extra work.

The process in accordance with the invention can be carried out by providing one longitudinal edge of the flat strip of sheet metal with a row of equidistant smaller perforations and the other longitudinal edge with another row of equidistant perforations. Each smaller perforation is opposite a larger perforation perpendicular to the longer dimension of the strip of metal, and the structural section is then shaped along with its flanges in such a way that each smaller perforation will be completely covered by a larger perforation.

Although the perforations can basically be of any desired shape, even square for example, they will preferably be drilled or stamped out round.

Although the structural section can also basically be of any desired shape, a box section will be preferable for reasons of stability. The edges can be overlapped along one side of the structural section and the panel can be subsequently screwed thereto. Preferably, however, there will be flanges extending parallel to the plane of the door panel from the actual boxshaped section or space enclosed therein and into the space enclosed by the frame.

To provide for different means of mounting the panel and make it possible for the consumer himself to mount it, the perforations are distributed along the web in a particular modulus or array. Each pair of perforations that will overlap when the section has been shaped is positioned opposite each other perpendicular to the length of the strip in the flat strip of metal that will later be shaped into the section.

It is also possible to attach a corner iron or similar structure to the perforated flanges and to mount the panel on the corner iron. It is preferable for one area of a flange itself to accommodate the panel whereby the outer surface of the edge area of the flange with the smaller perforations, the perforations with the same diameter as the screws that secure the panel, is especially practical as a contact surface for the panel.

The invention will now be described with reference to the preferred embodiment illustrated by way of example in the drawing.

BRIEF DESCRIPTION OF THE DRAWINGS

FIG. 2 is a contracted illustration of the strip of sheet metal that the section in FIG. 1 is shaped out of.

DESCRIPTION OF THE PREFERRED EMBODIMENTS

Figure 1:
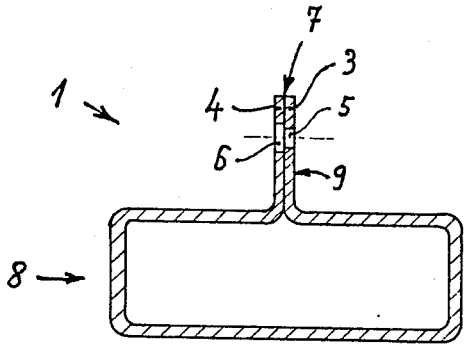
FIG. 1 is a sectional view through one length of the box-shaped section in the embodiment where two perforations coincide.
Figure 2:
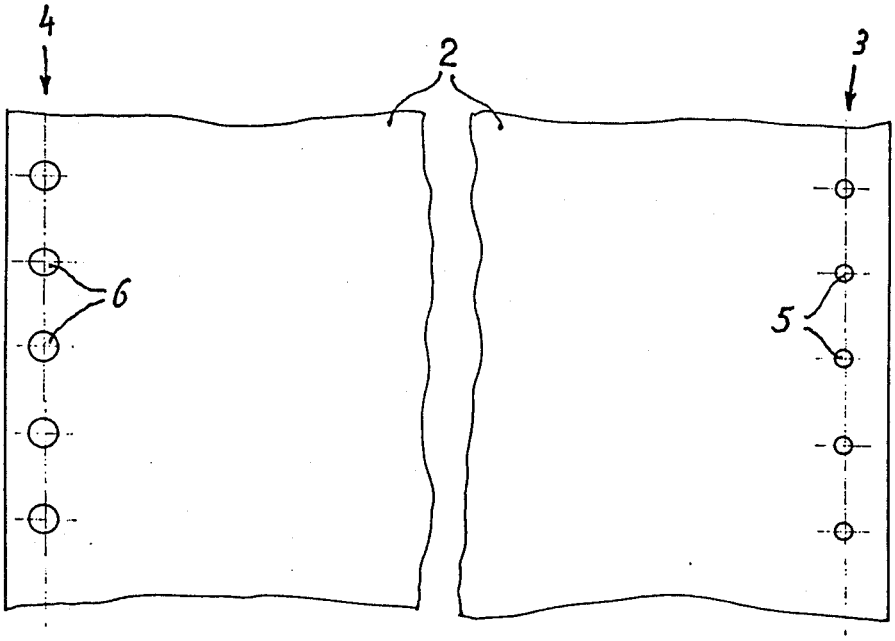

The structural section 1 illustrated in section in FIG. 1 is created from a flat strip 2 of sheet metal, which is illustrated as broken along its midsection in FIG. 2. A row of perforations 5 and 6 is introduced in an equidistant modulus (array) into each longitudinal edge 3 and 4 of strip 2 before it is shaped, while it is still flat. The perforations can be either drilled or stamped out. The perforations are round in the latter case in this particular embodiment. The diameter of the perforations 5 in the longitudinal edge 3 is the same as that of the fasteners, especially screws or rivets, that will later be introduced to secure the wooden panel. The perforations 6 in longitudinal border 4, on the other hand, are larger. How much larger perforations 6 are than perforations 5 depends on the manufacturing tolerance that occurs when structural section 1 is shaped out of strip 2 of sheet metal or on the extent to which longitudinal edges 3 and 4 are mutually displaced where they join into flanges 7 as will be evident from FIG. 1.

The strip 2 of sheet metal in this embodiment is, once perforations 5 and 6 have been introduced into longitudinal borders 3 and 4, shaped into the length 8 of the box-shaped section illustrated in FIG. 1, with longitudinal edges 3 and 4 joined parallel into flanges 7. Each pair of perforations 5 and 6 is accordingly made to coincide in such a way that, even when longitudinal edges 3 and 4 are mutually displaced due to manufacturing tolerance, each perforation 6 will be positioned so as to cover the cross-section of a perforation 5. Thus, the screws or other structures that secure the panel will always pass through both associated perforations 5 and 6 even given the afore-said manufacturing tolerance. The longitudinal edge 3 with the smaller perforations 5 will accordingly be positioned at flanges 7 in such a way that the screws will be introduced first through perforations 5 and then through perforations 6.

Thus, the outer surface of the longitudinal edge 3 with the smaller perforations 5 will function as a contact surface 9 for the wooden panel.

I claim:

1. A structural framing member for framing a wooden door or gate, particularly swinging doors, comprising: a strip of sheet metal with two parallel longitudinal edges; a first one of said edges having a row of openings of predetermined size corresponding to the cross-section of a fastening member for fastening the door to said framing member; the second one of said edges having a row of openings with size exceeding said predetermined size of said openings in said first one of said edges; said strip of sheet metal being shaped after generating said rows of openings into a structural member having a web with two connecting flanges, said two flanges comprising said two parallel longitudinal edges joined by spot welding; said two flanges after said shaping abutting with the openings in said second one of said edges overlapping the openings in said first one of said edges, areas of said openings in said first one of said edges being smaller than the areas of the larger overlapping openings in said second one of said edges; said openings in said second one of said edges having a predetermined size so that projected areas of said openings in said second edge surround overlappingly the areas of the openings in said first edge independent of any misalignment of said flanges and openings resulting from said shaping, whereby a fastening member passed through the openings in said first edge will pass theeafter unobstructed through the holes in said second edge; an outer surface of said first one of said edges comprising a contact surface for the door to be fastened to said flanges.

2. A structural framing member as defined in claim 1, wherein said openings have a circular shape.

3. A structural framing member as defined in claim 1, wherein said web has a box-shaped cross-section, said flanges extending parallel to the plane of the door connected to said flanges, an edge of the door facing said box-shaped section.

4. A structural framing member as defined in claim 1, wherein said outer surface has said smaller openings for receiving said fastening member to fasten the door to said flanges.

5. A structural framing member as defined in claim 1, wherein the openings in each row in each of said edges are distributed at predetermined intervals and in a predetermined modulus.

* * * * *